US010538349B2

(12) United States Patent
Hession et al.

(10) Patent No.: US 10,538,349 B2
(45) Date of Patent: Jan. 21, 2020

(54) DISPLAY CARTON

(71) Applicant: Altria Client Services LLC, Richmond, VA (US)

(72) Inventors: Christopher J. Hession, Mechanicsville, VA (US); Daniel Richter, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 346 days.

(21) Appl. No.: 14/813,345

(22) Filed: Jul. 30, 2015

(65) Prior Publication Data

US 2016/0031590 A1 Feb. 4, 2016

Related U.S. Application Data

(60) Provisional application No. 62/031,960, filed on Aug. 1, 2014.

(51) Int. Cl.

| | |
|---|---|
| ***B65D 5/70*** | (2006.01) |
| ***B65B 5/02*** | (2006.01) |
| ***A24F 23/00*** | (2006.01) |

(52) U.S. Cl.

CPC ..... *B65B 5/026* (2013.01); *A24F 23/00* (2013.01)

(58) Field of Classification Search

CPC ..... A24F 23/00; B65B 5/026; B65B 5/024; B65D 5/5233; B65D 5/20; B65D 5/4266; B65D 5/70

USPC ..... 206/736, 750; 229/108

See application file for complete search history.

(56) References Cited

U.S. PATENT DOCUMENTS

| | | | | | |
|---|---|---|---|---|---|
| 1,669,856 | A * | 5/1928 | Emlen | B65D 5/22 | 206/45.29 |
| 2,027,079 | A * | 1/1936 | Weiss | B65D 5/524 | 206/45.29 |
| 2,444,709 | A * | 7/1948 | Mulnix | B65D 5/5233 | 229/155 |
| 2,960,149 | A * | 11/1960 | Throssel | A47D 1/02 | 229/112 |
| 3,219,253 | A * | 11/1965 | Davis | B65D 5/422 | 206/216 |
| 4,053,101 | A * | 10/1977 | Hart, Jr. | B65D 5/2047 | 206/736 |
| 4,116,330 | A * | 9/1978 | Ellis | B65D 5/4208 | 206/736 |
| 4,306,658 | A * | 12/1981 | Montealegre | A47J 36/022 | 229/101 |
| 4,361,236 | A * | 11/1982 | Lavery | B65D 5/248 | 206/807 |
| 4,632,301 | A * | 12/1986 | Slack | B65D 5/248 | 206/292 |

(Continued)

*Primary Examiner* — Steven A. Reynolds

(74) *Attorney, Agent, or Firm* — Harness, Dickey & Pierce, P.L.C.

(57) ABSTRACT

A display carton is disclosed, which includes a tray portion, the tray portion including a back panel, a bottom panel, a front panel, an inside front panel, a right back gusset panel, a left back gusset panel, a right side wall panel, a left side wall panel, a right front gusset panel, and a left front gusset panel; a display portion, the display portion including an extension panel, a display panel, and a top panel, the top panel foldably connected along a fold line to the back panel of the tray portion; and a removable front panel portion foldably connected along a fold line to the inside front panel.

23 Claims, 6 Drawing Sheets

(56) References Cited

U.S. PATENT DOCUMENTS

| | | | | | |
|---|---|---|---|---|---|
| 4,641,746 | A * | 2/1987 | Dornbusch | B65D 71/125 | 206/45.21 |
| 5,217,159 | A * | 6/1993 | Calvert | B29C 66/1122 | 229/136 |
| 5,358,176 | A * | 10/1994 | Rigby | B65D 5/546 | 229/227 |
| 5,752,597 | A * | 5/1998 | Brangle, Jr. | B65D 5/542 | 206/45.21 |
| 5,967,407 | A * | 10/1999 | Mueller | B65D 5/22 | 229/125.19 |
| 7,422,217 | B2 * | 9/2008 | Hinnant | F41J 1/10 | 273/407 |
| 7,784,617 | B2 * | 8/2010 | Urban | B65D 5/2038 | 206/45.25 |
| 8,893,880 | B2 * | 11/2014 | Fath | B65D 5/42 | 206/45.29 |
| 9,211,970 | B2 * | 12/2015 | Hubbard, Jr. | B65D 5/6644 | |
| 2013/0334096 | A1 * | 12/2013 | Fath | A24F 23/00 | 206/774 |

* cited by examiner

DISPLAY CARTON

CROSS REFERENCE TO RELATED APPLICATION

This application claims priority under 35 U.S.C. § 119(e) to U.S. provisional Application No. 62/031,960, filed on Aug. 1, 2014, the entire content of which is incorporated herein by reference.

WORKING ENVIRONMENT

A wide variety of different types of merchandising units can be used for shipping and displaying retail consumer goods at the point of sale. For example, in shops and kiosks, the retail consumer goods can be displayed on shelves, freestanding counter top displays, or similar wall mounted display units.

SUMMARY

In accordance with an exemplary embodiment, a display carton comprises: a tray portion, the tray portion including a back panel, a bottom panel, a front panel, an inside front panel, a right back gusset panel, a left back gusset panel, a right side wall panel, a left side wall panel, a right front gusset panel, and a left front gusset panel; a display portion, the display portion including an extension panel, a display panel, and a top panel, the top panel foldably connected along a fold line to the back panel of the tray portion; and a removable front panel portion foldably connected along a fold line to the inside front panel.

In accordance with an exemplary embodiment, a blank for forming a carton, which is operable to contain a plurality of articles, comprises: an extension panel foldably connected to a display panel along a first edge of the display panel; a top panel foldably connected to the display panel along a second edge of the top panel; a back panel foldably connected to the top panel along a second edge of the top panel, the back panel connected to a right back gusset panel and a left back gusset panel along a right side edge and a left side edge of the back panel, respectively; a bottom panel foldably connected to the back panel along a second edge of the back panel, the bottom panel connected to a right side wall panel and a left side wall panel along a right side edge and a left side edge of the bottom panel, respectively; a front panel foldably connected to the bottom panel along a second edge of the bottom panel, the front panel connected to a right front gusset panel and a left front gusset panel along a right side edge and a left side edge of the front panel, respectively; an inside front panel foldably connected to the front panel along a second edge of the front panel; a front closure panel foldably connected to the inside front panel along a second edge of the inside front panel; and a front closure flap foldably connected to the front closure panel along a second edge of the front closure panel.

In accordance with an exemplary embodiment, a method of erecting a folded carton from a blank, the blank having an extension panel foldably connected to an display panel along a first edge of the display panel, a top panel foldably connected to the display panel along a second edge of the top panel, a back panel foldably connected to the top panel along a second edge of the top panel, the back panel connected to a right back gusset panel and a left back gusset panel along a right side edge and a left side edge of the back panel, respectively, a bottom panel foldably connected to the back panel along a second edge of the back panel, the bottom panel connected to a right side wall panel and a left side wall panel along a right side edge and a left side edge of the bottom panel, respectively, each of the right and left side wall panels having an inner panel and an outer panel, a front panel foldably connected to the bottom panel along a second edge of the bottom panel, the front panel connected to a right front gusset panel and a left front gusset panel along a right side edge and a left side edge of the front panel, respectively, an inside front panel foldably connected to the front panel along a second edge of the front panel, a front closure panel foldably connected to the inside front panel along a second edge of the inside front panel, and a front closure flap foldably connected to the front closure panel along a second edge of the front closure panel, the method comprises: folding the extension panel and the display panel inwardly to about 90 degrees; folding the inside front panel to about 90 degrees; folding the right back gusset panel and the right front gusset panel inwardly bringing upward the right side wall panel; folding the outer panel over the inner panel of the right side wall panel; tucking a tuck tab on the outer panel of the right side wall panel into a slot between the right side wall panel and the bottom panel; folding the left back gusset panel and the left front gusset panel inwardly bringing upward the left side wall panel; folding the outer panel over the inner panel of the left side wall panel; and tucking a tuck tab on the outer panel of the left side wall panel into a slot between the left side wall panel and the bottom panel.

BRIEF DESCRIPTION OF THE DRAWINGS

The subject matter of the disclosure will be explained in more detail in the following text with reference to exemplary embodiments which can be illustrated in the attached drawings, in which.

DETAILED DESCRIPTION

In accordance with an exemplary embodiment, a folded structure or display carton 300 (FIG. 3) is disclosed, which can be used to hold retail products 520 (FIG. 5) primarily during shipping and for display at retail. In accordance with an exemplary embodiment, the display carton 300, for example, can be made from paperboard or plastic, for example, 18 to 24 point paperboard. In addition, in accordance with an exemplary embodiment, the carton 300 can be decorated if desired, such as with printing, embossing/debossing, foil stamping and the like.

Figure 1:
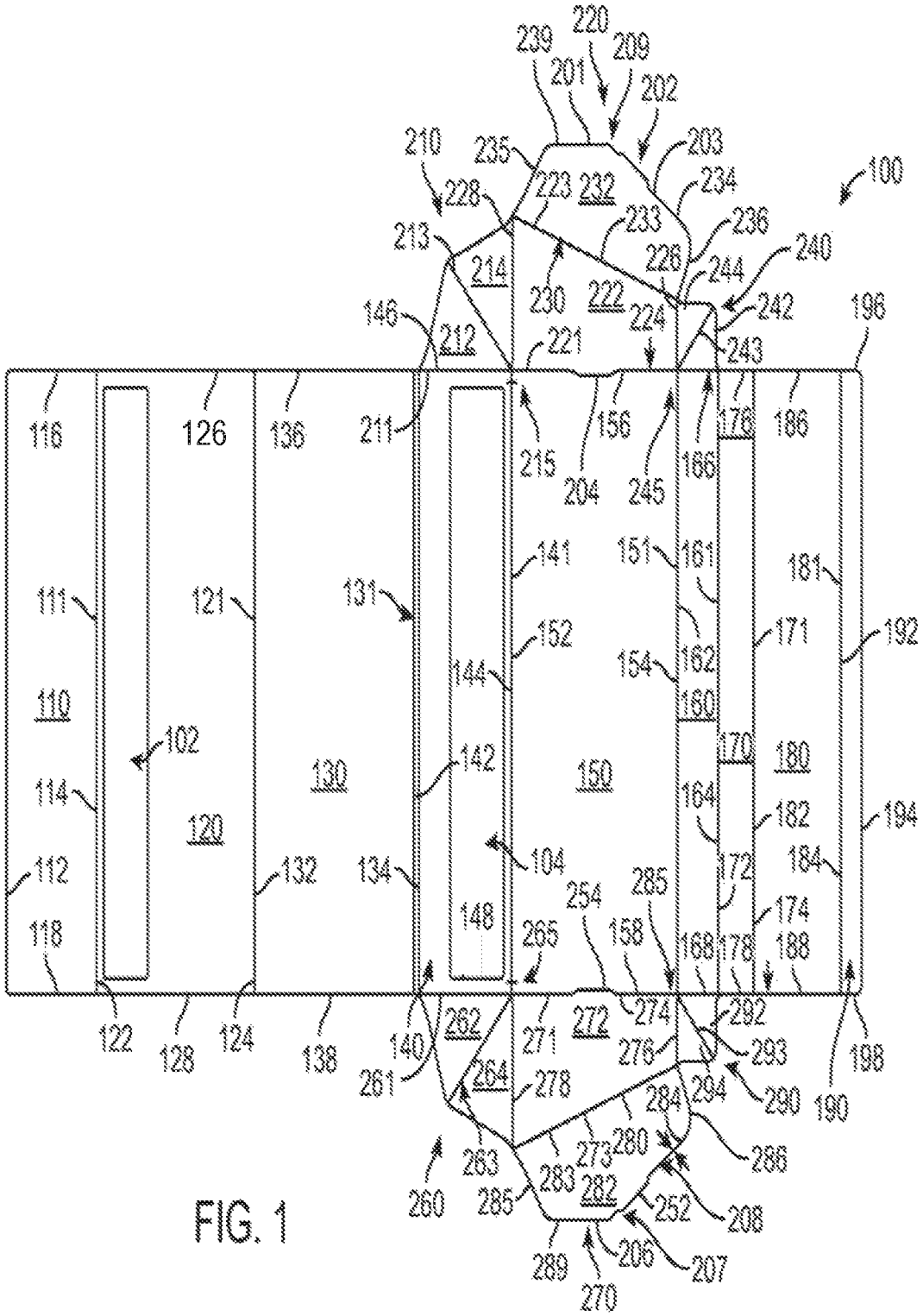
FIG. 1 is a frontside of a blank for forming a display carton in accordance with an exemplary embodiment.

FIG. 1 is a frontside of a blank 100 for forming a display carton 300 (FIG. 3) in accordance with an exemplary embodiment. As shown in FIG. 1, the blank 100 includes an extension panel 110, a display (or inner back) panel 120, a top (or lid) panel 130, a back panel 140, a bottom panel 150, a front panel 160, an inside front panel 170, a front closure panel 180, and a front closure flap 190.

The extension panel 110 is connected to the inner back (or display) panel 120 along a fold line 111 to a first edge 122 of the display panel 120. The extension panel 110 has a first (or free) edge 112, a second edge 114, a top (or right side) edge 116, and a bottom (or left side) edge 118. The display panel 120 includes a first edge 122, a second edge 124, a top (or right side) edge 126, and a bottom (or left side) edge 128. The top (or lid) panel 130 is connected to the display panel 120 along a fold line 121 to the second edge 124 of the display panel 120. The top (or lid) panel 130 includes a first edge 132, a second edge 134, a top (or right side) edge 136 and a bottom (or left side) edge 138. In accordance with an exemplary embodiment, the display panel 120 can include a front health warning box area 102, which can extend across the width of the panel 120.

In accordance with an exemplary embodiment, the back panel 140 is connected to the top panel 130 along fold line 131 to the second edge 134 of the top panel 130. In accordance with an exemplary embodiment, the fold line 131 can have a width greater than other fold lines, for example, fold lines 111, 121. In accordance with an exemplary embodiment, fold line 131 can have a width of about 0.094 inches, and wherein, for example, fold lines 111, 121, are 2 point or 1/36 of an inch in width. The back panel 140 includes a first edge 142, a second edge 144, a top (or right side) edge 146, and a bottom (or left side) edge 148. A right back gusset panel 210 and a left back gusset panel 260 are connected along fold lines 211, 261 to the right side edge 146 and the left side edge 148 of the back panel 140, respectively.

In accordance with an exemplary embodiment, the right and left back gusset panels 210, 260 include a pair of triangular panels 212, 214, 262, 264, which include the inner triangular panel 212, 262, which is foldably connected along the top or right side edge 146 and the left side edge 148 of the back panel 140, respectively. The right and left back gusset panels 210, 260 are configured to be inwardly foldable along fold lines 213, 263 during erecting of the carton 300. Each of the pair of triangular panels 212, 214, 262, 264, has a corner (or vertices) 215, 265 foldably connected to a corner of the side wall panel 220, 270 and second edge 144 of the back panel 140. In accordance with an exemplary embodiment, the back panel 140 can include a front health warning box area 104, which can extend across a width of the panel 140. In accordance with an exemplary embodiment, the inner triangular panels 212, 262 can have an angle of about 45 to 46, and more preferably, about 45.5 degrees from the corner (or vertices) 215, 265 foldably connected to the corner of the side wall panel 220, 270, and the second edge 144 of the back panel 140.

A bottom panel 150 is connected to the back panel 140 along a fold 141 line to the second edge 144 of the back panel 140. The bottom panel 150 includes a first edge 152, a second edge 154, a top (or right side) edge 156, and a bottom (or left side) edge 158. A right side wall panel 220 and a left side wall panel 270 are connected along fold lines 221, 271 to the right side edge 156 and the left side edge 158 of the bottom panel 150, respectively.

In accordance with an exemplary embodiment, the right side wall panel 220 and the left side wall panel 270 include an inner panel 222, 272, and an outer panel 232, 282. The inner panels 222, 272 are connected along the right and left side edges 156, 158, respectively of the bottom panel 150. The inner panels 222, 272 can include a horizontal edge 224, 274, a front vertical edge 226, 276, a back vertical edge 228, 278, and angular edge 230, 280 extending from the front vertical edge 226, 276 to the back vertical edge 228, 278. In accordance with an exemplary embodiment, the front vertical edge 226, 276 adjacent to the fold line 151 between the bottom panel 150 and the front panel 160 is shorter than the back vertical edge 228, 278 adjacent to the fold line 141 between the back panel 140 and bottom panel 150.

In accordance with an exemplary embodiment, the outer panel 232, 282 includes an angular edge 223, 273 connected along a fold line 233, 283 to the angular edge 230, 280, and an outer edge 234, 284 having a pair of generally parallel edges 235, 236, 285, 286, which are perpendicular to the angular edge 223, 273. The parallel edges 235, 236, 285, 286 have a pair of rounded edges, which extend to an outer edge 239, 289. Each of the outer edges 239, 289 includes a tuck tab 202, 252, which is configured to be received within a slot 204, 254. The slot 204, 254 extends along a center portion of fold lines 221, 271 between the right side wall panel 220 and a left side wall panel 270 and the right side edge 156 and the left side edge 158 of the bottom panel 150, respectively. In accordance with an exemplary embodiment, the outer edges 239, 289 of the outer panels 232, 282, can include a horizontal edge 201, 206, which extends to a slightly rounded edge 209, 207, to an angled edge 203, 208. Upon folding the outer panels 232, 282 downward approximately 180 degrees over fold lines 233, 283, the angled edge 203, 208 runs parallel to the fold lines 221, 271 of the inner panels 222, 272.

A front panel 160 is connected to the bottom panel 150 along a fold line to the second edge 154 of the bottom panel 150. The front panel 160 includes a first edge 162, a second edge 164, a top (or right side) edge 166, and a bottom (or left side) edge 168. A right front gusset panel 240 and a left front gusset panel 290 can be connected along fold lines to the right side edge 166 and the left side edge 168 of the front panel 160, respectively.

In accordance with an exemplary embodiment, the right and left front gusset panels 240, 290 include a pair of triangular panels 242, 244, 292, 294, which include an inner triangular panel 242, 292, which is foldably connected along the top or right side edge 166 and the left side edge 168 of the front panel 160, respectively. The right and left front gusset panels 240, 290 are configured to be inwardly foldable along fold line 243, 293 during erecting of the carton 300. Each of the pair of triangular panels 242, 244, 292, 294, has a corner (or vertices) 245, 285 foldably connected to a corner of the side wall panel 220, 270 and the first edge 162 of the front panel 160. In accordance with an exemplary embodiment, the inner triangular panels 242, 292 can have an angle of about 45 to 47, and more preferably, about 46 degrees from the corner (or vertices) 245, 285 foldably connected to the corner of the side wall panel 220, 270 and the first edge 162 of the front panel 160.

An inside front panel 170 is connected to the front panel 160 along a fold line to the second edge 164 of the front panel 160. The inside front panel 170 includes a first edge 172, a second edge 174, a top (or right side) edge 176, and a bottom (or left side) edge 178. A front closure panel 180 is connected to the inside front panel 170 along a fold line 171 to the second edge 174 of the inside front panel 170. The front disclosure panel 180 includes a first edge 182, a second edge 184, a top (or right side) edge 186, and a bottom (or left side) edge 188. A front closure flap 190 is connected to the front closure panel 180 along a fold line 181 to the second edge 184 of the front closure panel 180. The front closure 190 includes a first edge 192, a second (or free) edge 194, a top (or right side) edge 196, and a bottom (or left side) edge 198.

Figure 2:
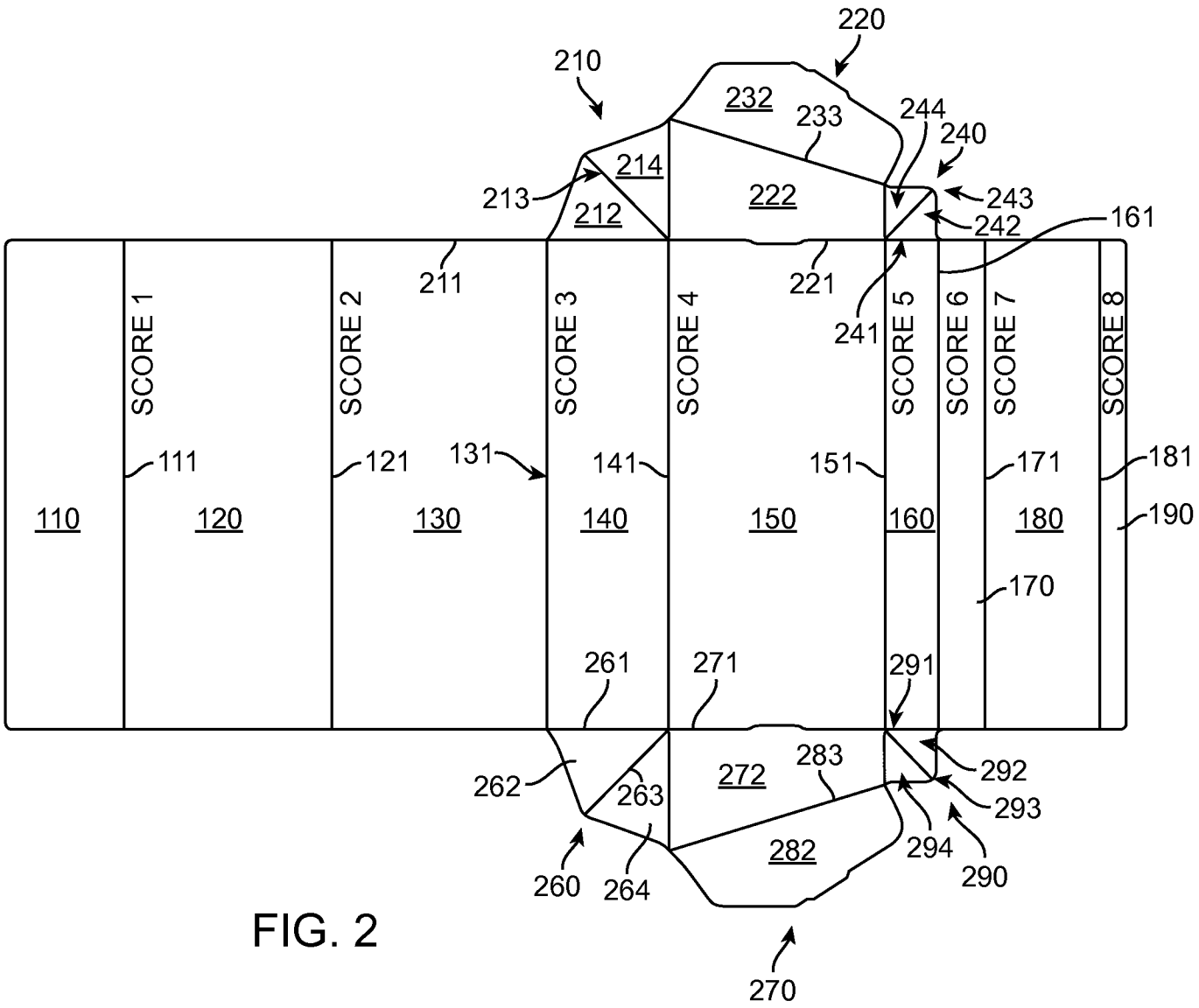
FIG. 2 is a frontside of a blank for forming a display carton in accordance with an exemplary embodiment.

FIG. 2 is a frontside of a blank 100 for forming a display carton 300 in accordance with an exemplary embodiment. As shown in FIG. 2, the blank 100 includes the extension panel 110 foldably connected to the inner back (or display) panel 120 along a first fold line or score 111. The display panel 120 foldably connected to the top (or lid) panel 130 along a second fold line or score 121. The top (or lid) panel 130 foldably connected to the back panel 140 along a third fold line or score 131. The back panel 140 foldably connected to the bottom panel 150 along a fourth fold line or score 141. The bottom panel 150 foldably connected to the front panel 160 along a fifth fold line or score 151. The front panel 160 foldably connected to the inside front panel 170 along a sixth fold line or score 161. The inside front panel 170 foldably connected to the front closure panel 180 along a seventh fold line or score 171, and the front closure panel 180 foldably connected to the front closure flap 190 along an eight fold line or score 181. In accordance with an exemplary embodiment, the seventh fold line or score 171 is a perforated fold or score line, which is configured such that the front closure panel 180 can be separated from the inside front panel 170 by a tearing motion. For example, the seventh fold line or score 171 can be a ¾ inch by 1/16 of an inch perforation. In accordance with an exemplary embodiment, the eight fold line or score 181 is a perforated fold line or score, such that the front closure flap 190 can be easily folded over at a 90 degree angle to bring the flap 190 in contact with a retail product 520 during shipping of the display carton 300. For example, the eight fold line or score 181 can be a ⅛ of an inch by ⅛ of an inch perforation The right back gusset panel 210 and a left back gusset panel 260 are connected along fold lines 211, 261 to the right side edge 146 and the left side edge 148 of the back panel 140, respectively. In accordance with an exemplary embodiment, the right and left back gusset panels 210, 260 can be configured to be inwardly folded during erecting of the carton 300 along fold lines 213, 263. In accordance with an exemplary embodiment, fold lines 211, 213, 261, 263 can be a perforated fold line, which can be relatively easy to fold inwardly during assembly of the display carton 300 before shipping. For example, the fold lines 211, 213, 261, 263 can be a ⅛ of an inch by ⅛ of an inch perforation.

The right side wall panel 220 and a left side wall panel 270 are connected along fold lines 221, 271 to the right side edge 156 and the left side edge 158 of the bottom panel 150, respectively. In accordance with an exemplary embodiment, the right side wall panel 220 and the left side wall panel 270 include an inner panel 222, 272 and an outer panel 224, 274, which are connected to one another along fold lines 233, 283, respectively.

The right front gusset panel 240 and a left front gusset panel 290 are connected along fold lines to the right side edge 166 and the left side edge 168 of the front panel 160, respectively. In accordance with an exemplary embodiment, the right and left back gusset panels 240, 290 are configured to be inwardly folded during erecting of the carton 300 along fold lines 243, 293, respectively.

In accordance with an exemplary embodiment, the frontside of the blank 100 as shown in FIGS. 1 and 2 are folded into the page. In accordance with an exemplary embodiment, as disclosed herein, each of the panels of the blank 100 can be separated from an adjacent panel by a fold or hinge line. In addition, one or more of the hinge or fold lines can be a plurality of perforations extending from one edge of the blank 100 to another edge of the blank 100.

In accordance with an exemplary embodiment, an adhesive can be applied to a backside of the top panel 130, and the display panel 120 can be folded over 180 degrees to adhere the backside of the top panel 130 to a backside of the display panel 120. In addition, an adhesive can be applied to a backside of the front panel 160, and the inside front panel 170 can be folded 180 degrees over fold line 161 to adhere the backside of the front panel 160 to a backside of the inside front panel 170. In accordance with an exemplary embodiment, the adhesive can be applied to either the backside of the display panel 120 or the top panel 130. In addition, the adhesive can be applied to either the backside of the front panel 160 or the inside front panel 170.

Figure 3:
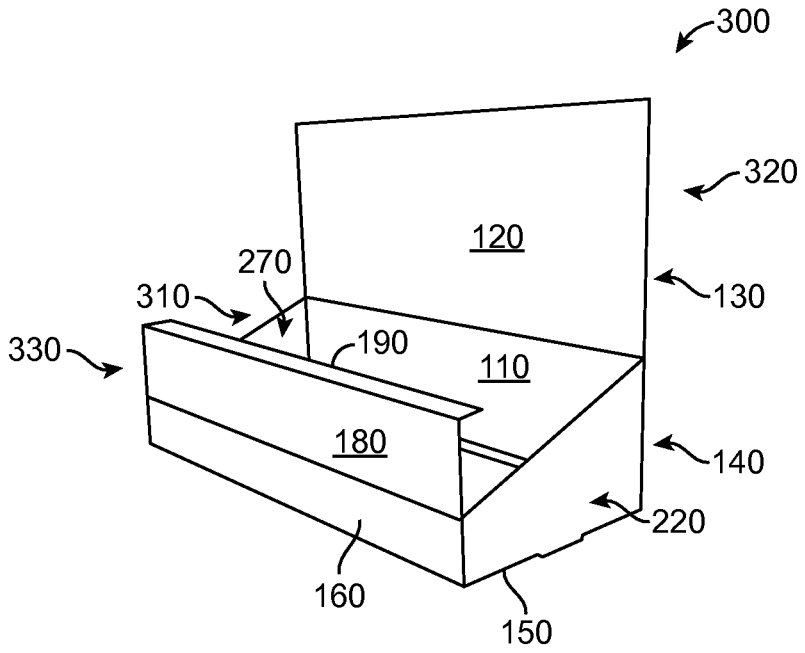
FIG. 3 is a perspective view of an assembled display carton in accordance with an exemplary embodiment.

FIG. 3 is a perspective view of an assembled display carton 300 in accordance with an exemplary embodiment. The display carton 300 can include a tray portion 310, a display portion 320, and a removable front panel 330. In accordance with an exemplary embodiment, the tray portion 310 can include the extension panel 110, the back panel 140, the bottom panel 150, the front panel 160, the inside front panel 170, the right back gusset panel 210, the left back gusset panel 260, the right side wall panel 220, the left side wall panel 270, the right front gusset panel 240 and the left front gusset panel 290. The display (or lid) portion 320 can include the top (or lid) panel 130 and the back panel 140. The removable front panel portion 330 can include the front closure panel 180 and the front closure flap 190.

In accordance with an exemplary embodiment, the tray portion 310 can be hand erected and/or at least partially assembled by machine. In accordance with an exemplary embodiment, the display carton 300 can include an overly wide and extended display portion (or lid) 320, doubled over side walls or panels 220, 270, and an interior (or inside) front panel 170.

In accordance with an exemplary embodiment, the assembled display carton 300 can have a width of about 8 to 14 inches, for example, 10 to 12 inches, and more preferably a width of about 11 inches, a depth of about 4 to 6 inches, for example, about 5 inches, and a tray portion 310 having a front panel height of about 1.0 to 1.5 inches, for example 1.25 inches, and a back panel height of about 2.5 to 3.5 inches, for example, 2.813 inches, and total display panel height of about 7 to 9 inches, for example, 7.5 inches.

For example, by incorporating an extended lid portion 320, which has width greater than an interior width of the tray portion 310 can help cause the back panels (the display panels) 130, 140 to bow slightly because the extension panel 110 can be slightly larger than the interior space available within the tray portion 310. For example, in accordance with an exemplary embodiment, the extension panel 110 can be about 1/32" to 3/32" wider than the interior width of the tray portion 310. In accordance with an exemplary embodiment, the bowed action from the extension panel 110 can help keep the lid portion 320 from falling forward by putting stress along the fold lines where the lid portion 310 meets the base of the display carton 300.

In accordance with an exemplary embodiment, the extension panel 110 can be attached to the interior side of the lid portion by a fold line or score 111 (FIGS. 1 and 2). The score 111 is preferably offset 3/32" from the fold line or score 131 between the top panel 130 and an exterior side of the back panel 140. This offset can allow the lid portion 320 to fold normally for shipping without having the interior display panel 120 butt up against the back panel 140 of the tray portion 310. The result is that when the lid portion 320 is opened and closed, the extension panel 110 moves up and down. The doubled over side walls or panels 220, 270 can also create interference with the extension panel 110 by restricting its movement upward and downward, and thus can help to keep the lid portion 320 upright once opened.

In accordance with an exemplary embodiment, the inside front panel 160 and the front panel 170 of the tray portion 310 are folded over at a 180 degree angle to provide a clean look at retail. In accordance with an exemplary embodiment, since the height of the front panels 160, 170 has been reduced, the height of the front panels 160, 170 can cause the retail product 520 (FIGS. 5C and 5D) to be less secure during shipping. To address this issue, in accordance with an exemplary embodiment, the display carton 300 can include a removal front panel 180 and front closure flap 190 on the interior side of the folded inside front panel 170. Once the tray portion 310 is set-up, the attached removable front panel 180 and front closure flap 190 can be lifted up in parallel with the front panels 160, 170, and the tray portion 310 can be loaded.

FIGS. 4A-4G are views of a method of erecting a display carton 300 from a blank 100 as shown in FIGS. 1 and 2 in accordance with an exemplary embodiment.

Figure 4A:
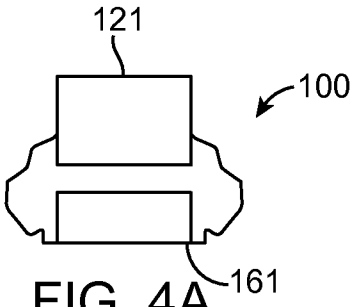
FIGS. 4A-4G are views of a method of erecting a display carton from a blank as shown in FIGS. 2 and 3 in accordance with an exemplary embodiment.

FIG. 4A shows an exemplary embodiment of the blank 100 for the display carton 300 after the gluing. As shown in FIG. 4A, an adhesive can be applied to a backside of the display panel 120, and the top panel 130 can be folded over 180 degrees along fold line 121 to adhere the backside of the top panel 130 to a backside of the display panel 120. In addition, an adhesive can be applied to a backside of the front panel 160, and the inside front panel 170 can be folded 180 degrees over fold line 161 to adhere the backside of the inside front panel 170 to a backside of the front panel 160.

Figure 4B:
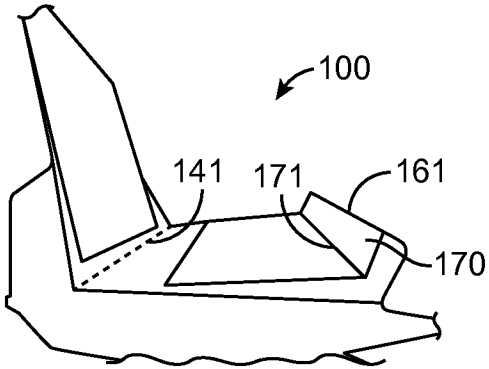

As shown in FIG. 4B, the extension panel 110 and the inner back panel 120 are folded inwardly to about 90 degrees along fold line 141. In addition, the inside front panel 170 is folded inwardly to about 90 degrees along fold lines 161, 171.

Figure 4C:
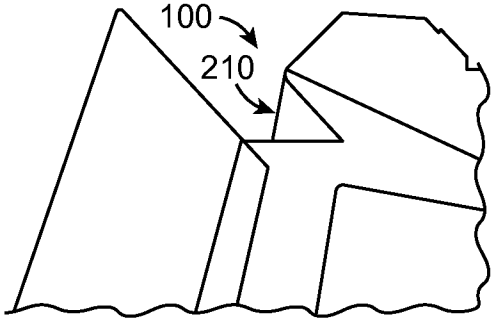
Figure 4D:
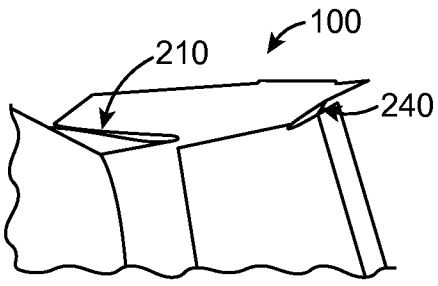

As partially shown in FIGS. 4C and 4D, the right back gusset panel 210 and a left back gusset panel 260 are inwardly folded along fold lines 213, 263, and the right and left back gusset panels 240, 290 are configured to be inwardly folded during erecting of the carton 300 along fold lines 243, 293. In addition, the right and left side walls 220, 270 are brought upward to vertical position.

Figure 4E:
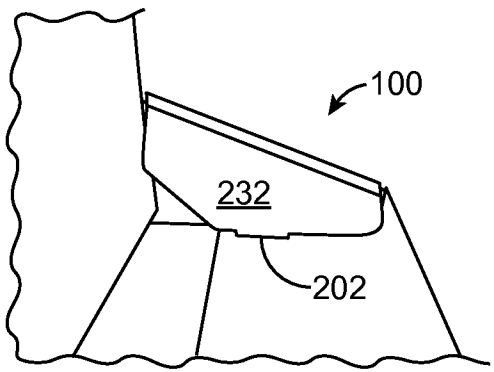
Figure 4F:
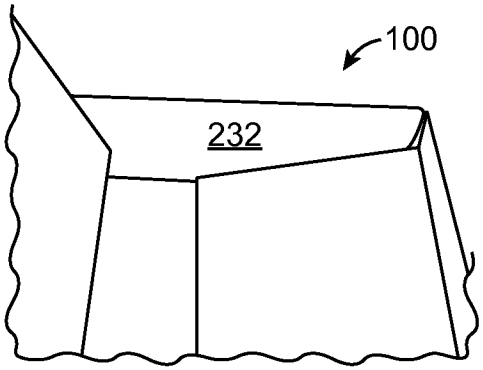
Figure 4G:
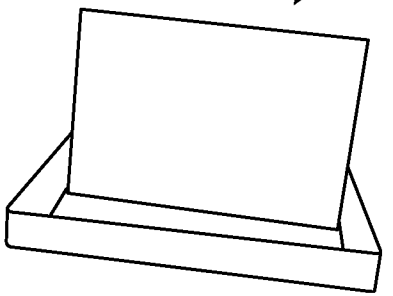

As partially shown in FIG. 4E, the outer panels 232, 282 can be folded 180 degrees about fold lines 233, 283. In FIG. 4F, the tuck tab 202, 252 on each of the outer panels 232, 282 are inserted into the slots 204, 254 within fold lines 221, 271. The steps as shown in FIGS. 4C-4F can be repeated for the other side and the carton 300 is ready for loading.

Figure 5A:
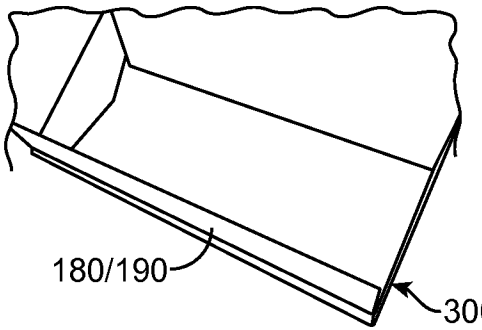
FIGS. 5A-5F are views of a method of loading a retail product into an erected display carton in accordance with an exemplary embodiment.
Figure 5B:
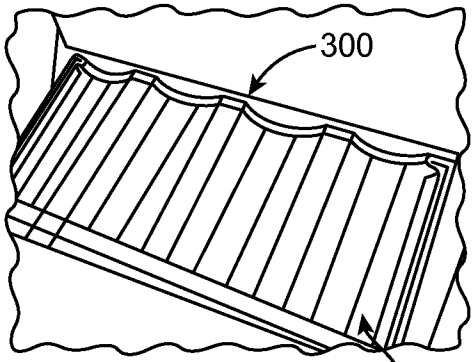

FIGS. 5A-5F are views of a method of loading a retail product 520 into an erected display carton 300 in accordance with an exemplary embodiment. As shown in FIG. 5A, the removable front panel 180 and the front closure flap 190 are lifted upward so that the panels 180, 190 can be approximately vertical. As shown in FIG. 5B, an optional tray 510 can be inserted into the tray portion 310 of the carton 300. It can be appreciated that the carton 300 can be used to ship retail products, for example, boxed or rectangular items without use of a tray 510.

Figure 5C:
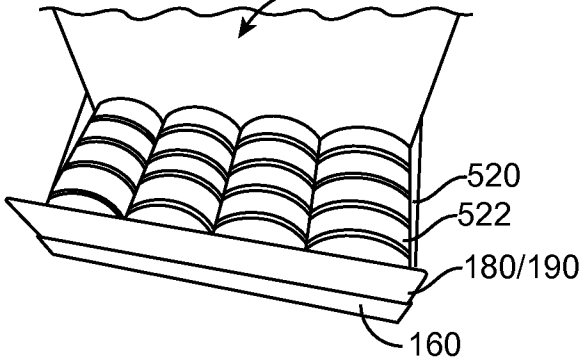

In accordance with an exemplary embodiment, the tray 510 can be made of plastic or paper material and can be configured to hold two or more rows of retail product 520. For example, in accordance with an exemplary embodiment, the retail product 520 can be cylindrical cans or canisters 522 of a retail product 520 preferably in the form of a smokeless tobacco product. The smokeless tobacco product can be a moist smokeless tobacco product, such as a chewing tobacco, dip and/or a snus type product (e.g. Copenhagen®). As shown in FIG. 5C, the retail product 520 can be loaded into the two or more rows of the tray 510. For example, in accordance with an exemplary embodiment, the tray 510 can include four (4) rows of five (5) cylindrical cans or canisters 522, for a total of 20 cylindrical cans or canisters 522.

Figure 5D:
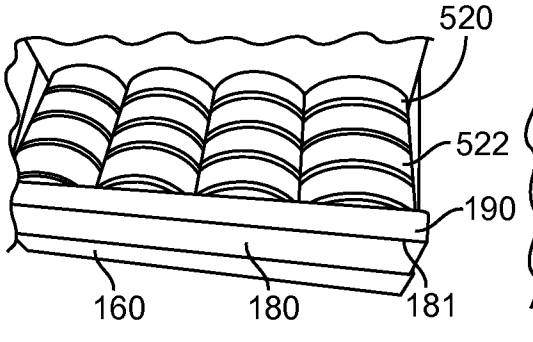
Figure 5E:
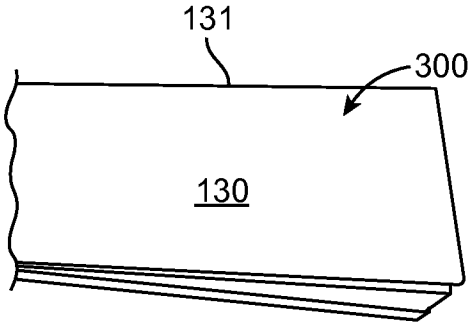
Figure 5F:
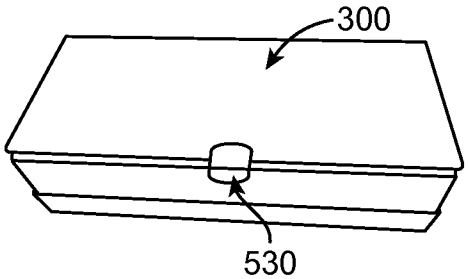

As shown in FIG. 5D, the front closure flap 190 is folded 90 degrees about fold line 181 until the front closure flap 190 is in contact with a first row of retail product. As shown in FIG. 5E, the inner back (or display) panel 120 and the top panel 130 are folded about fold line 131 to close the lid 320. A wafer seal 530 can be applied in a center of the display carton 300 to close the lid portion 320.

In accordance with an exemplary embodiment, the tray 510 can be thermoformed insert, which can be used to hold the retail product 520 in place, for example, to keep the retail product 520 from shingling (or falling over in a stack or pile) at retail. Once the retail product 520 has been loaded, the removable front panel 180 and the front closure flap 190 can serve as a means to keep the lid portion 320 closed by applying a tape or a wafer seal 530 to affix the top panel 130 of the lid portion 320 to the removable front panel 180 and/or the front closure flap 190. In accordance with an exemplary embodiment, a slit (not shown) can be added to the fold line 121 between the top panel 120 and the display panel 130, and a tuck tab (not shown) can be provided, which can be part of the removable front panel 180 and/or front closure flap 190. For example, in accordance with an exemplary embodiment, the tuck tab can be a cutout in the front closure flap 190.

Figure 6:
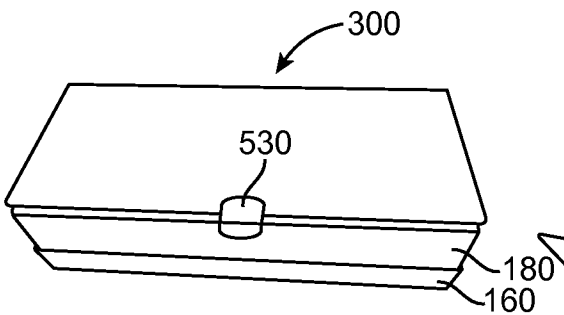
FIG. 6 is a perspective view of an erected display carton which has been loaded with a retail product and a wafer seal has been applied to the carton in accordance with an exemplary embodiment.

FIG. 6 is a perspective view of an erected display carton 300 which has been loaded with a retail product 520 and a wafer seal 530 has been affixed to the carton 300 in accordance with an exemplary embodiment.

Figure 7:
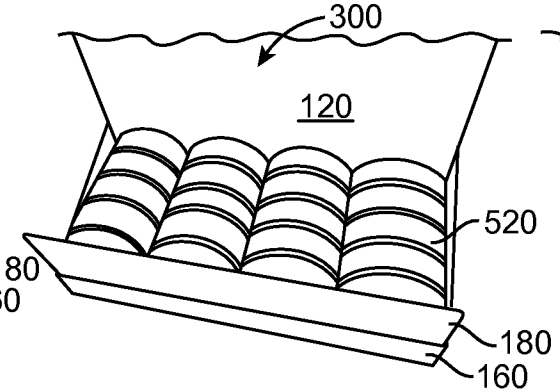
FIG. 7 is a perspective view of an erected display carton, which has been opened in accordance with an exemplary embodiment.

FIG. 7 is a perspective view of an erected display carton 300, which has been opened in accordance with an exemplary embodiment. As shown in FIG. 7, the wafer seal 530 can be broken, and the display carton 300 can be opened by raising the display panel 120 and the top panel 130 to approximately 90 degrees.

Figure 8:
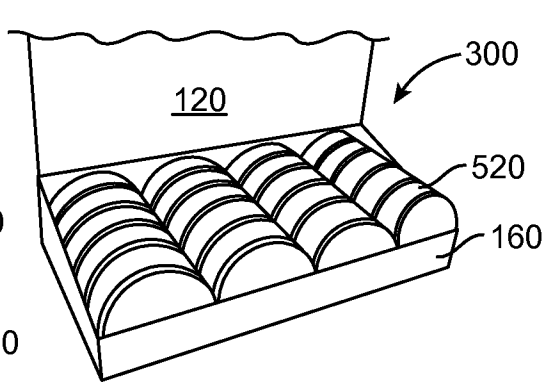
FIG. 8 is a perspective view of a display carton on display in which a front closure panel has been removed in accordance with an exemplary embodiment.

FIG. 8 is a perspective view of a display carton 300 on display in which the front closure panel 180 (and the front closure flap 190) have been removed in accordance with an exemplary embodiment. In accordance with an exemplary embodiment, at retail, the wafer seal or tape 530 can be broken (or tab removed from the slot) and the removable front panel 180 and front closure flap 190 can be free to move. In addition, as set forth above, once the front panel 180 and the front closure flap 190 are removed, the ragged edges of the torn removable front panel 180 are hidden, providing a very clean look at retail relative to the current retail displays. Thus, the display carton 300 can have high visibility of package branding at retail, and as disclosed herein, the carton display has improved stability of the display panel 120 (or "header card") at retail, such that it is less likely to sag or close on its own at retail.

In the preferred embodiment, exterior surfaces of the carton 300 may be printed, embossed, debossed or otherwise embellished with manufacturer or brand logos, trademarks, slogans and other consumer information and indicia.

As used herein, the terms "front", "back", "upper, "lower", "side", "top", "bottom", "left", "right" and other terms used to describe relative positions of the components of the box refer to the carton 300 in an upright position.

In accordance with an exemplary embodiment, the fold and/or score lines are 2 point rule (or 1/36 of an inch).

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness. In addition, cut line extends partially into and/or completely through the material along the desired line of weakness so as to separate one portion of a panel or panels from another portion of a panel or panels.

In this specification, the word "about" is sometimes used in connection with numerical values to indicate that mathematical precision is not intended. Accordingly, where the word "about" is used with a numerical value, that numerical value should be interpreted to include a tolerance ±10% of the stated numerical value.

It will now be apparent to those skilled in the art that the foregoing specification describes with particularity a display carton. Moreover, it will also be apparent to those skilled in the art that various modifications, substitutions, variations, and equivalents exist for claimed features of container. Accordingly, it is expressly intended that all such modifications, substitutions, variations, and equivalents for claimed features of the container, which fall within the spirit and scope of the invention as defined by the appended claims, be embraced thereby.

What is claimed is:

1. A display carton comprising:

a tray portion, the tray portion assembled from a blank including a back panel, a bottom panel, a front panel, an inside front panel, a right back gusset panel, a left back gusset panel, a right side wall panel, a left side wall panel, a right front gusset panel, and a left front gusset panel, wherein each of the right and left side wall panels includes an inner panel and an outer panel, and wherein upon erecting the carton, the outer panel is folded over the inner panel forming a double sided side wall, each of the inner panels having a horizontal edge, a front vertical edge, a back vertical edge, the front vertical edge being shorter in length than the back vertical edge, and an inner angular edge extending from the front vertical edge to the back vertical edge, and each of the outer panels includes an outer angular edge connected along a fold line to the inner angular edge, a pair of parallel edges, which are perpendicular to the outer angular edge, and an outer edge, the outer edge having a horizontal edge, which extends to a slightly rounded edge to an angled edge, and upon folding the outer panel downward approximately 180 degrees, the angled edge is parallel to a fold line of the inner panel;

a display portion, the display portion assembled from the blank including an extension panel, a display panel, and a top panel, the top panel foldably connected along a fold line to the back panel of the tray portion; and a removable front panel portion of the blank which is foldably connected along a fold line to the inside front panel.

2. The carton of claim 1, comprising:

a front closure panel foldably connected along a fold line to the removable front panel.

3. The carton of claim 1, comprising:

a tray configured to be received in the tray portion of the display carton, and wherein the tray is configured to hold one or more rows of a retail product.

4. The carton of claim 1, comprising:

a retail product, which is received in the tray portion of the display carton.

5. The carton of claim 4, wherein the retail product is a plurality of cylindrical cans or canisters, each of the plurality of cylindrical cans containing a moist smokeless tobacco product.

6. The carton of claim 1, wherein a height of the back panel is greater than a height of the front panel.

7. The carton of claim 1, comprising:

a slit between the display panel and the top panel; and a tuck tab in the front closure flap, and wherein the tuck tab is configured to tuck into the slit between the display panel and the top panel.

8. The carton of claim 1, wherein each of the pairs of parallel edges has a pair of rounded edges, which extend to the outer edge.

9. The carton of claim 1, wherein each of the outer edges includes a tuck tab, which is configured to be received within a slot extending along a center portion of a fold line between the right side wall panel and the left side wall panel and the right side edge and the left side edge of the bottom panel, respectively.

10. The carton of claim 1, wherein each of the right and left back gusset panels includes a pair of triangular panels, which are configured to be inwardly foldable during erecting of the carton, and wherein each of the right and left front gusset panels includes a pair of triangular panels, which are configured to be inwardly foldable during erecting of the carton.

11. The carton of claim 1, wherein a width of the extension panel, the display panel, and the top panel are greater than an interior width of the tray portion upon assembly.

12. A blank for forming a carton, which is operable to contain a plurality of articles, comprising:

an extension panel foldably connected to a display panel along a first edge of the display panel;

a top panel foldably connected to the display panel along a second edge of the display panel;

a back panel foldably connected to the top panel along a second edge of the top panel, the back panel connected to a right back gusset panel and a left back gusset panel along a right side edge and a left side edge of the back panel, respectively;

a bottom panel foldably connected to the back panel along a second edge of the back panel, the bottom panel connected to a right side wall panel and a left side wall panel along a right side edge and a left side edge of the bottom panel, respectively, and wherein each of the right and left side wall panels includes an inner panel and an outer panel, and wherein upon erecting the carton, the outer panel is folded over the inner panel forming a double sided side wall, each of the inner panels having a horizontal edge, a front vertical edge, a back vertical edge, the front vertical edge being shorter in length than the back vertical edge, and an inner angular edge extending from the front vertical edge to the back vertical edge, and each of the outer panels includes an outer angular edge connected along a fold line to the inner angular edge, a pair of parallel edges, which are perpendicular to the outer angular edge, and an outer edge, the outer edge having a horizontal edge, which extends to a slightly rounded edge to an angled edge, and upon folding the outer panel downward approximately 180 degrees, the angled edge is parallel to a fold line of the inner panel;

a front panel foldably connected to the bottom panel along a second edge of the bottom panel, the front panel connected to a right front gusset panel and a left front gusset panel along a right side edge and a left side edge of the front panel, respectively;

an inside front panel foldably connected to the front panel along a second edge of the front panel;

a front closure panel foldably connected to the inside front panel along a second edge of the inside front panel; and a front closure flap foldably connected to the front closure panel along a second edge of the front closure panel.

13. The blank of claim 12, wherein each of the right and left back gusset panels includes a pair of triangular panels, which are configured to be inwardly foldable during erecting of the carton.

14. The blank of claim 12, wherein each of the right and left front gusset panels includes a pair of triangular panels, which are configured to be inwardly foldable during erecting of the carton.

15. The blank of claim 12, wherein a first fold line between the bottom panel and the right side wall panel includes a first slot and a second fold line between the bottom panel and the left side wall panel includes a second slot, and wherein the first and second slots are configured to receive a corresponding tuck tab on an outer free edge of the outer panels of the right and left side wall panels.

16. The blank of claim 12, wherein a width of the extension panel, the display panel, and the top panel are greater than an interior width of the carton upon assembly.

17. A method of erecting a folded carton from a blank, the blank having an extension panel foldably connected to an display panel along a first edge of the display panel, a top panel foldably connected to the display panel along a second edge of the display panel, a back panel foldably connected to the top panel along a second edge of the top panel, the back panel connected to a right back gusset panel and a left back gusset panel along a right side edge and a left side edge of the back panel, respectively, a bottom panel foldably connected to the back panel along a second edge of the back panel, the bottom panel connected to a right side wall panel and a left side wall panel along a right side edge and a left side edge of the bottom panel, respectively, each of the right and left side wall panels having an inner panel and an outer panel, each of the inner panels having a horizontal edge, a front vertical edge, a back vertical edge, the front vertical edge being shorter in length than the back vertical edge, and an inner angular edge extending from the front vertical edge to the back vertical edge, and each of the outer panels includes an outer angular edge connected along a fold line to the inner angular edge, a pair of parallel edges, which are perpendicular to the outer angular edge, and an outer edge, the outer edge having a horizontal edge, which extends to a slightly rounded edge to an angled edge, and upon folding the outer panel downward approximately 180 degrees, the angled edge is parallel to a fold line of the inner panel, a front panel foldably connected to the bottom panel along a second edge of the bottom panel, the front panel connected to a right front gusset panel and a left front gusset panel along a right side edge and a left side edge of the front panel, respectively, an inside front panel foldably connected to the front panel along a second edge of the front panel, a front closure panel foldably connected to the inside front panel along a second edge of the inside front panel, and a front closure flap foldably connected to the front closure panel along a second edge of the front closure panel, the method comprising:

folding the extension panel and the display panel inwardly to about 90 degrees;

folding the inside front panel to about 90 degrees;

folding the right back gusset panel and the right front gusset panel inwardly bringing upward the right side wall panel;

folding the outer panel over the inner panel of the right side wall panel;

tucking a tuck tab on the outer panel of the right side wall panel into a slot between the right side wall panel and the bottom panel;

folding the left back gusset panel and the left front gusset panel inwardly bringing upward the left side wall panel;

folding the outer panel over the inner panel of the left side wall panel; and tucking a tuck tab on the outer panel of the left side wall panel into a slot between the left side wall panel and the bottom panel.

18. The method of claim 17, wherein before forming the carton:

applying an adhesive to a backside of the display panel, and folding the top panel over 180 degrees to adhere the backside of the top panel to the backside of the display panel; and applying an adhesive to a backside of the front panel, and folding the inside front panel 180 degrees to adhere the backside of the inside front panel to the backside of the front panel.

19. The method of claim 17, comprising:

lifting upward the removable front panel and the front closure panel; and inserting a tray into the carton.

20. The method of claim 19, comprising:

placing a retail product into the tray.

21. The method of claim 20, comprising:

folding the front closure flap about 90 degrees until the front closure flap contacts a first row of retail product in the tray;

folding the display panel and the top panel downward; and applying a seal to an outer portion of the top panel and the removable front panel to close the carton for shipping.

22. The method of claim 21, comprising:

breaking the seal; and raising the display panel and the top panel to approximately 90 degrees.

23. The method of claim 22, comprising:

removing the removable front panel and the front closure panel from the carton.

* * * * *